US005562120A

United States Patent [19]

Spano et al.

[11] Patent Number: 5,562,120

[45] Date of Patent: Oct. 8, 1996

[54] VALVE ASSEMBLY FOR A FAUCET HANDLE

[75] Inventors: Donna A. Spano, Chatham, N.J.; Rudolf Steffes, Mueckeln, Germany

[73] Assignee: American Standard Inc., Piscataway, N.J.

[21] Appl. No.: 430,064

[22] Filed: Apr. 27, 1995

[51] Int. Cl.[6] ..... F16L 5/00

[52] U.S. Cl. ..... 137/359; 137/801; 4/678

[58] Field of Search ..... 137/359, 801; 4/678

[56] References Cited

U.S. PATENT DOCUMENTS

| | | | |
|---|---|---|---|
| 1,516,594 | 11/1924 | Fischer . | |
| 1,665,436 | 4/1928 | Bloch | 137/359 |
| 2,608,378 | 8/1952 | Hinderer | 251/156 |
| 2,896,222 | 7/1959 | Freibott | 4/191 |
| 2,966,924 | 1/1961 | Young | 137/359 |
| 3,043,330 | 7/1962 | Young | 137/359 |
| 3,067,436 | 12/1962 | Freibott | 4/191 |
| 3,331,386 | 7/1967 | Politz | 137/359 |
| 3,376,888 | 4/1968 | Anthony | 137/359 |
| 3,556,140 | 1/1971 | Politz | 137/359 |
| 3,789,870 | 2/1974 | Keller, III | 137/359 |
| 4,457,342 | 7/1984 | Moen | 137/801 |
| 4,662,389 | 5/1987 | Ighal | 137/359 |
| 4,739,788 | 4/1988 | Reback | 137/15 |
| 4,842,009 | 6/1989 | Reback | 137/315 |
| 4,961,443 | 10/1990 | Buccicone et al. | 137/315 |
| 5,232,008 | 8/1993 | Jeffress et al. | 137/15 |
| 5,291,622 | 3/1994 | Humpert | 4/678 |

*Primary Examiner*—A. Michael Chambers

*Attorney, Agent, or Firm*—Elaine Brenner Robinson; Ann M. Knab

[57] ABSTRACT

A valve assembly for a faucet handle comprises a valve body, a bonnet nut and a cartridge mounted therein. The valve assembly is factory assembled and tested and is adapted to fit within sink deck openings for easy installation.

3 Claims, 2 Drawing Sheets

VALVE ASSEMBLY FOR A FAUCET HANDLE

BACKGROUND OF THE INVENTION

The present invention is directed to a valve assembly for faucet handles and in particular to the construction of a valve assembly for mounting a faucet handle to a sink deck.

Conventionally, faucet valve bodies and valve handles are concealed and must be installed below a sink deck. The installation of these fittings is sometimes awkward and cumbersome since it involves reaching underneath the sink deck to mount the fittings to the deck. Commercial faucet handle valves typically include a series of components such as washers, locknuts, bonnet nuts, escutcheons and escutcheon nuts for mounting and securing the valves and handles to the sink deck. These components are assembled during the installation of the valve body and handle to the sink deck.

A typical faucet handle installation involves fastening a series of washers and nuts to a valve body on the underside of the deck and inserting the valve body in an opening in the sink deck. The valve cartridge is inserted in the valve body and another series of washers and nuts are mounted atop the sink deck on the valve body over the valve cartridge. A bonnet nut is usually then mounted thereon, over which an escutcheon, escutcheon nut and handle are mounted. The bonnet nut is not exposed, but hidden from view by the escutcheon. During installation the valve cartridge must be tested for defects such as leakage and must be properly adjusted for torque and tension. If the torque is not properly adjusted, users of the faucet handle may have difficulty operating the handle and various components may subsequently loosen and become damaged or dislodge entirely causing water damage and even scalding if the hot water valve malfunctions. If the components are damaged, time, labor and money are lost and new parts must be obtained.

Thus, it is apparent that a preassembled and factory tested valve assembly is desired. It is preferable that the escutcheon is sized to fit over the valve cartridge and to support all valve components above the sink deck. Moreover, it is advantageous to provide a bonnet nut which fits within the deck opening and is aesthetically pleasing.

SUMMARY OF THE INVENTION

It is therefore an object of the invention to reduce the number of components necessary for installation of a valve assembly.

It is another object to assemble the valve body, cartridge and bonnet nut at the factory.

It is a related object to adjust the torque of the valve assembly and check for defects before shipment thereof.

These and other objects and advantages are achieved by the present invention which provides a valve assembly comprising a valve body, a valve cartridge and a bonnet nut mounted thereon. The valve assembly is factory assembled and tested and is adapted to fit within sink deck openings for easy installation.

BRIEF DESCRIPTION OF THE DRAWINGS

The invention will be more fully appreciated from the following detailed description when same is considered in connection with the accompanying drawing in which.

DETAILED DESCRIPTION OF THE INVENTION

Figure 1:
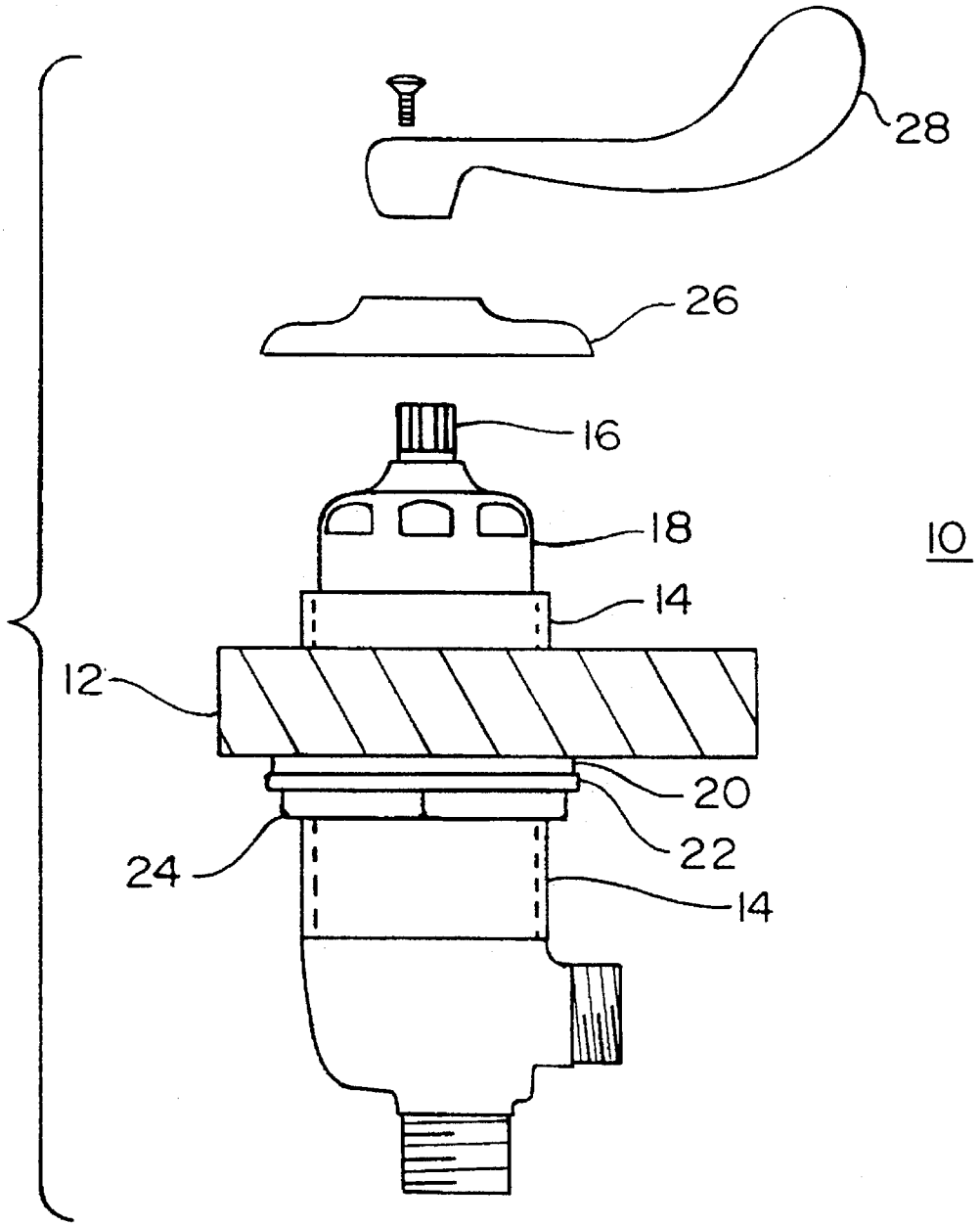
FIG. 1 shows a side view of the valve assembly of the present invention.
Figure 2:
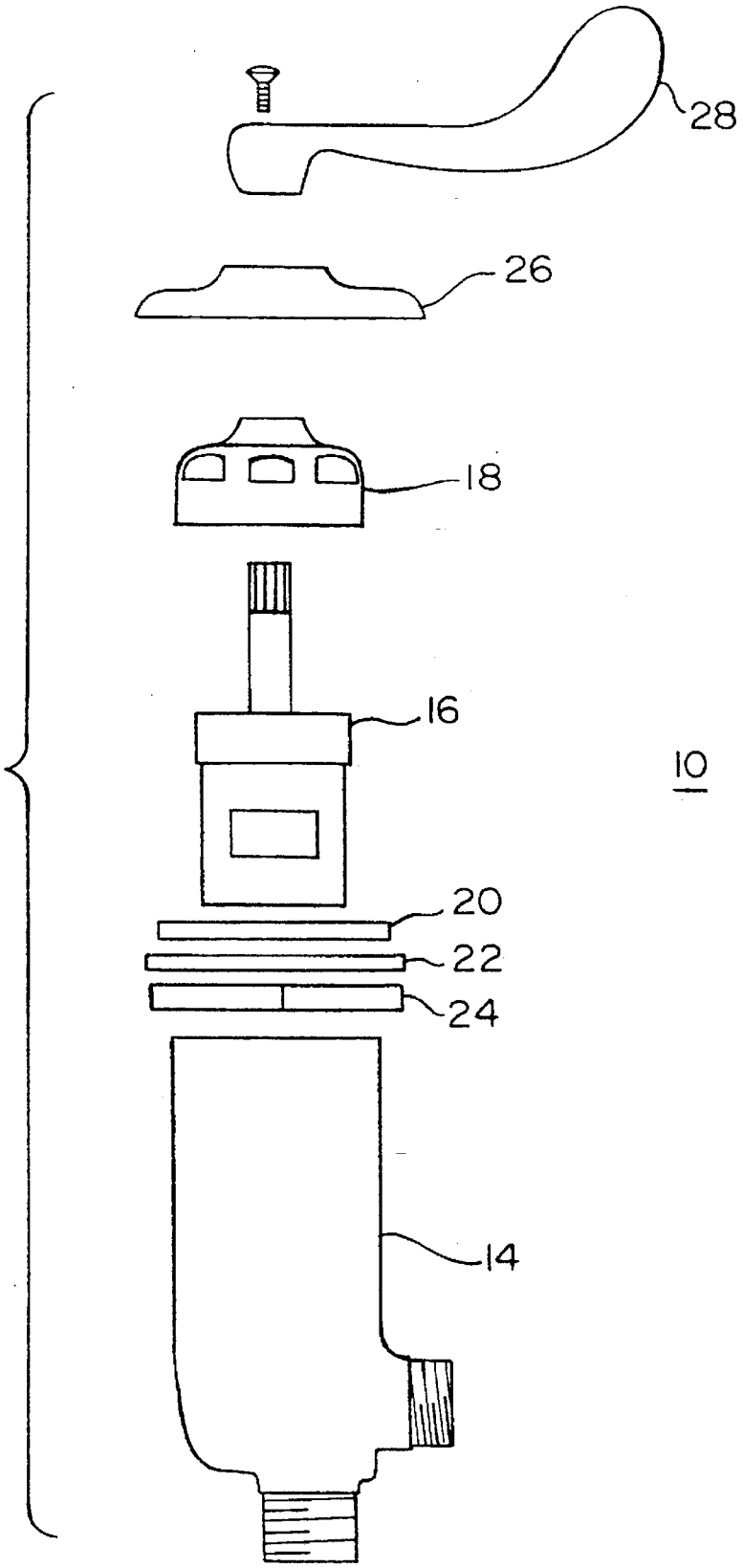
FIG. 2 shows an exploded view of the components in the valve assembly.

Reference is now made to FIG. 1 which depicts a valve assembly 10 mounted to a sink deck 12 and FIG. 2 which shows the various components prior to assembly. Valve assembly 10 includes a valve body 14 having a valve cartridge 16 inserted therein. A bonnet nut 18 is mounted in valve body 14 over cartridge 16 such that valve cartridge 16 extends through and above bonnet nut 18. The bonnet nut 18 is sized to fit within the sink deck openings, thus, it may be mounted on the valve body at the factory. This saves time and labor at installation of the valve assembly which normally requires assembling the bonnet nut to the valve body, adjusting the torque of the bonnet nut and testing for defects. The resulting valve assembly including valve body 14, valve cartridge 16 and bonnet nut 18 is then adjusted for proper torque and tested for leakage. Accordingly, the cartridge 16 inserted into the valve body 14 and the bonnet nut 18 mounted over the cartridge 16 onto the valve body 14 provide a factory assembled and tested valve assembly. After all testing is conducted, the assembly is ready for shipment.

For purposes of installation, the valve assembly is inserted into the sink deck opening and through a lower mounting means which is aligned with the opening. The mounting means is contiguous with the underside of the sink deck and typically includes a rubber washer 20, a brass washer 22 and a locknut 24. A portion of the valve body along with the cartridge and bonnet nut extend above the deck 12. An escutcheon 26 is mounted on valve body 14 over bonnet nut 18 and cartridge 16. Bonnet nut 18 extends within the opening of escutcheon 28 such that neither cartridge 16 nor valve body 14 is visible after installation of the valve assembly in the sink deck. The escutcheon 28 is constructed to clear the valve cartridge 16 and fasten directly to the valve body 14 to maintain the valve body 14 in place. A handle 26 is mounted on cartridge 16 to provide a means for turning on and off the water.

Installation of the valve assembly is quick and simple. Since the bonnet nut easily fits within the deck opening, it can be assembled to the valve body along with the valve cartridge at the factory. This allows for testing of the various components for leakage, torque, and workability since it is not possible to determine whether a cartridge is defective unless it is installed. This saves time and money which would have been spent on installing a defective product. It is not necessary to adjust the torque in the handle-valve cartridge connection since it is completed at the factory. The escutcheon is simply fastened to the valve body above the sink deck without any adjustments required. The bonnet nut serves two functions. It maintains the cartridge in place and acts as an ornamental covering which is exposed after installation. The construction of the valve assembly reduces the number of parts necessary to install a faucet handle providing a more efficient and functional product.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A valve assembly for mounting a faucet fitting to a sink deck having a top side and a bottom side and a plurality of openings comprising:

a valve body;

a bonnet nut;

a cartridge, said cartridge inserted in said valve body and said bonnet nut mounted on said valve body, said valve body with said bonnet nut thereon and said cartridge therein adapted to extend through said openings of said sink deck wherein said bonnet nut is visible as an ornamental component of said faucet fitting;

an escutcheon positioned on top of said sink deck such that said bonnet nut extends within an opening of said escutcheon; and a handle positioned on top of said cartridge whereby said bonnet nut is positioned between said escutcheon and said handle.

2. The assembly of claim 1 further including a mounting means for said valve body, said mounting means mounts said valve body to said bottom side of said sink deck.

3. The assembly of claim 2 wherein said mounting means includes a rubber washer, a brass washer and a locknut.

* * * * *